US012419355B2

(12) United States Patent
Zeng et al.

(10) Patent No.: US 12,419,355 B2
(45) Date of Patent: Sep. 23, 2025

(54) ATOMIZER AND ELECTRONIC ATOMIZING DEVICE

(71) Applicant: SHENZHEN SMOORE TECHNOLOGY LIMITED, Shenzhen (CN)

(72) Inventors: Xianglong Zeng, Shenzhen (CN); Songkai Chen, Shenzhen (CN); Jiyong Yang, Shenzhen (CN); Jingjing Yang, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 673 days.

(21) Appl. No.: 17/554,090

(22) Filed: Dec. 17, 2021

(65) Prior Publication Data

US 2022/0192270 A1 Jun. 23, 2022

(30) Foreign Application Priority Data

Dec. 18, 2020 (CN) ..... 202011505452.7

(51) Int. Cl.
*A24F 40/485* (2020.01)
*A24F 40/10* (2020.01)
*A24F 40/42* (2020.01)

(52) U.S. Cl.
CPC ..... *A24F 40/485* (2020.01); *A24F 40/10* (2020.01); *A24F 40/42* (2020.01)

(58) Field of Classification Search
None
See application file for complete search history.

(56) References Cited

FOREIGN PATENT DOCUMENTS

| | | | |
|---|---|---|---|
| CN | 104273650 | A | 1/2015 |
| CN | 109965365 | A | 7/2019 |
| CN | 209768986 | U | 12/2019 |
| CN | 210809300 | U | 6/2020 |
| CN | 210809307 | U | 6/2020 |
| CN | 111657549 | A | 9/2020 |
| CN | 112021659 | A | 12/2020 |

(Continued)

OTHER PUBLICATIONS

CN111657549A, "Electronic atomization device and atomizer thereof". (Year: 2020).*

(Continued)

*Primary Examiner* — Michael J Felton
(74) *Attorney, Agent, or Firm* — Ballard Spahr LLP

(57) ABSTRACT

The present disclosure relates to an atomizer and an electronic atomizing device. The atomizer is provided with an atomizing cavity, and includes: an atomizing core configured to atomize an aerosol generating substrate to form an aerosol; a base provided with an air inlet; and a sealing member disposed on the base, and having an upper surface facing the atomizing core. The sealing member includes a raised platform connected to the upper surface and protruding opposite to the upper surface. The raised platform is provided with an orifice channeling air flow around the atomizing cavity and the air inlet. The raised platform has an inclined surface located outside the orifice and facing the atomizing core. In a direction away from the orifice, a distance between the inclined surface and the upper surface gradually decreases.

10 Claims, 11 Drawing Sheets

(56) References Cited

FOREIGN PATENT DOCUMENTS

| | | | |
|---|---|---|---|
| CN | 215013581 | | 12/2021 |
| WO | 2018059218 | A1 | 4/2018 |
| WO | 2019144308 | A1 | 8/2019 |

OTHER PUBLICATIONS

CN209768986U, "Electronic cigarette and atomization device" (Year: 2019).*
Extended European Search Report for European Patent Application No. 21215705.1 mailed Jun. 1, 2022.
First Office Action for Chinese Application No. 202011505452.7 mailed Oct. 30, 2024.

* cited by examiner

ATOMIZER AND ELECTRONIC ATOMIZING DEVICE

CROSS-REFERENCE TO RELATED APPLICATION

This application claims to the priority of a Chinese patent disclosure No. 202011505452.7, filed on Dec. 18, 2020, the entire contents of which is incorporated herein by reference.

TECHNICAL FIELD

The present disclosure relates to the field of atomizing technology, in particular to an atomizer and an electronic atomizing device including the atomizer.

BACKGROUND

An electronic atomizing device generally includes an atomizer and a power supply. When the electronic atomizing device is out of use, e-liquid seeped from the atomizer or condensate formed by liquefaction of aerosol will leak from the bottom of the atomizer, to form leakage liquid. The leakage liquid will enter the power supply and corrode the power supply and even cause the power supply to explode, thereby affecting the service life and safety of the power supply.

SUMMARY

According to various exemplary embodiments, the present disclosure provides an atomizer and an electronic atomizing device including the atomizer.

An atomizer is provided with an atomizing cavity, and includes:

an atomizing core configured to atomize an aerosol generating substrate to form an aerosol;

a base provided with an air inlet; and a sealing member disposed on the base, and having an upper surface facing the atomizing core. The sealing member includes a raised platform connected to the upper surface and protruding opposite to the upper surface. The raised platform is provided with an orifice channeling air flow around the atomizing cavity and the air inlet. The raised platform has an inclined surface located outside the orifice and facing the atomizing core, for transferring liquid. In a direction away from the orifice, a distance between the inclined surface and the upper surface gradually decreases.

In one of the embodiments, the base is further provided with a storage portion configured to store the aerosol generating substrate. The sealing member further includes a lower surface away from the atomizing core. The orifice passes through the lower surface. The lower surface is provided with a flow diverting groove connected with the orifice. The flow diverting groove transfers the aerosol generating substrate from the orifice into the storage portion.

In one of the embodiments, more than one flow diverting groove is provided. The more than one flow diverting groove is distributed radially around a central axis of the orifice.

In one of the embodiments, the raised platform has a side wall surface defining a boundary of the orifice. The side wall surface is provided with a drainage groove connected with the flow diverting groove. An end of the drainage groove away from the flow diverting groove is located close to the inclined surface.

In one of the embodiments, the sealing member is provided with an open cavity. At least a part of the raised platform is located in the open cavity. The upper surface defines a part of a boundary of the open cavity. The upper surface is provided with a through hole. The base includes a positioning post cooperating with the through hole. The through hole is located in a remaining clearance between the positioning post and the sealing member. The remaining clearance connects the storage portion and the open cavity.

In one of the embodiments, the base has a bottom wall surface facing the atomizing core and defining a part of a boundary of the storage portion. The base includes a protruding portion. At least a part of the protruding portion is located in the storage portion. The protruding portion is connected to the bottom wall surface and protrudes relative to the bottom wall surface. The protruding portion has a free end surface spaced apart from the bottom wall surface. The air inlet passes through the free end surface.

In one of the embodiments, the sealing member is sleeved on the base and covers the storage portion.

In one of the embodiments, the atomizer further includes a liquid absorbing member. The liquid absorbing member is located in the storage portion and abuts against the sealing member, and is capable of absorbing the aerosol generating substrate from the orifice.

In one of the embodiments, the raised platform further includes at least two raised portions disposed at intervals along a circumference of the orifice. The raised portion protrudes toward the atomizing core relative to the inclined surface. The 1 inclined surface is located between two adjacent raised portions.

An electronic atomizing device includes a power supply and the atomizer according to any one of the embodiments. The atomizer is detachably connected to the power supply.

An embodiment of the present disclosure has a technical effect that, since the raised platform protrudes opposite to the upper surface, and the orifice is disposed on the raised platform, the raised platform has the inclined surface located outside the orifice. In the direction away from the orifice, the distance between the inclined surface and the upper surface gradually decreases. The aerosol generating substrate seeps from the atomizing core to form a seeped liquid, and the aerosol remaining in the atomizing cavity form the condensate after being liquefied. The seeped liquid and the condensate are termed as the leakage liquid. When the leakage liquid falls on the inclined surface, since the inclined surface inclines downward, the leakage liquid will fall along the inclined surface to the upper surface subjected to its own gravity. In addition, at least a part of the leakage liquid can finally be transferred into the storage portion, so as to prevent the leakage liquid from leaking out of the atomizer.

DETAILED DESCRIPTION OF THE EMBODIMENTS

Figure 1:
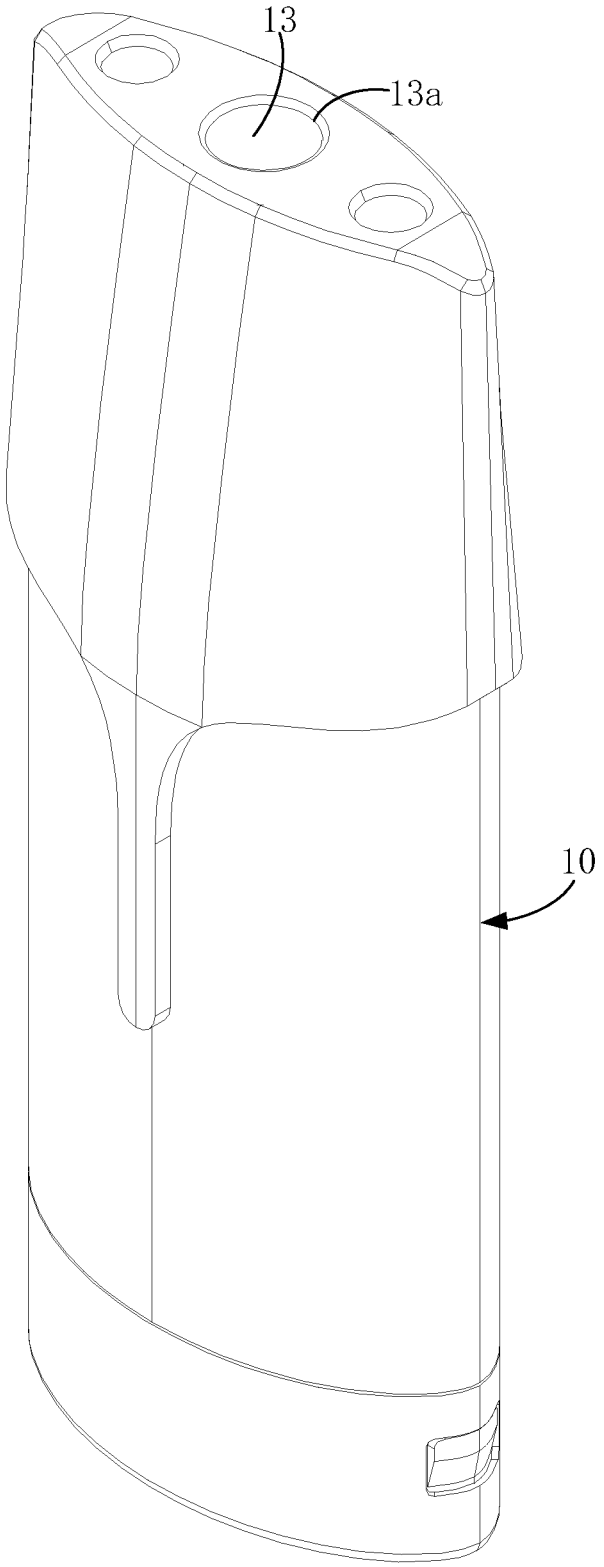
FIG. 1 is a perspective view of an atomizer according to an embodiment.

In order to facilitate the understanding of the present disclosure, the present disclosure will be described in a more comprehensive manner with reference to the relevant drawings. Exemplary embodiments of the present disclosure are shown in the drawings. However, the present disclosure can be implemented in many different forms and is not limited to the embodiments described herein. On the contrary, the purpose of providing these embodiments is to make the disclosure of the present disclosure more thorough and comprehensive.

It should be noted that when an element is referred to as being "fixed to" another element, it can be directly on another element or an intermediate element may also be present. When an element is considered to be "connected to" another element, it can be directly connected to another element or an intermediate element may be present at the same time. Terms "inner", "outer", "left", "right" and similar expressions used herein are for illustrative purposes only, and do not mean that they are the only embodiments.

Figure 2:
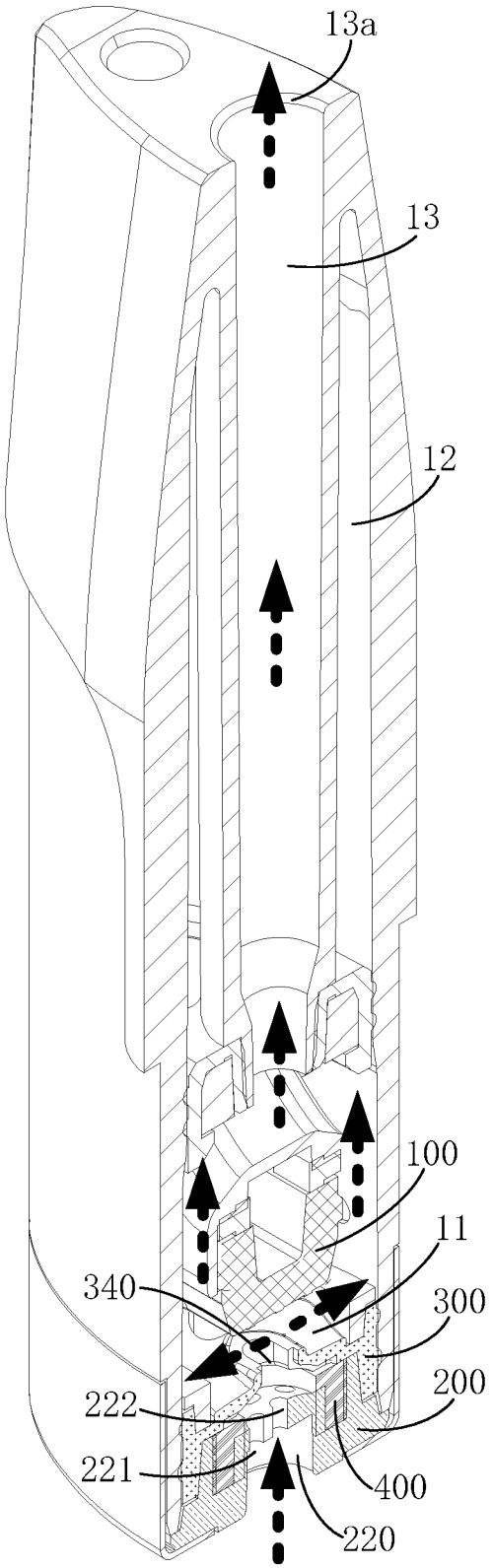
FIG. 2 is a perspective cross-sectional view of the atomizer of FIG. 1 in a first direction.
Figure 3:
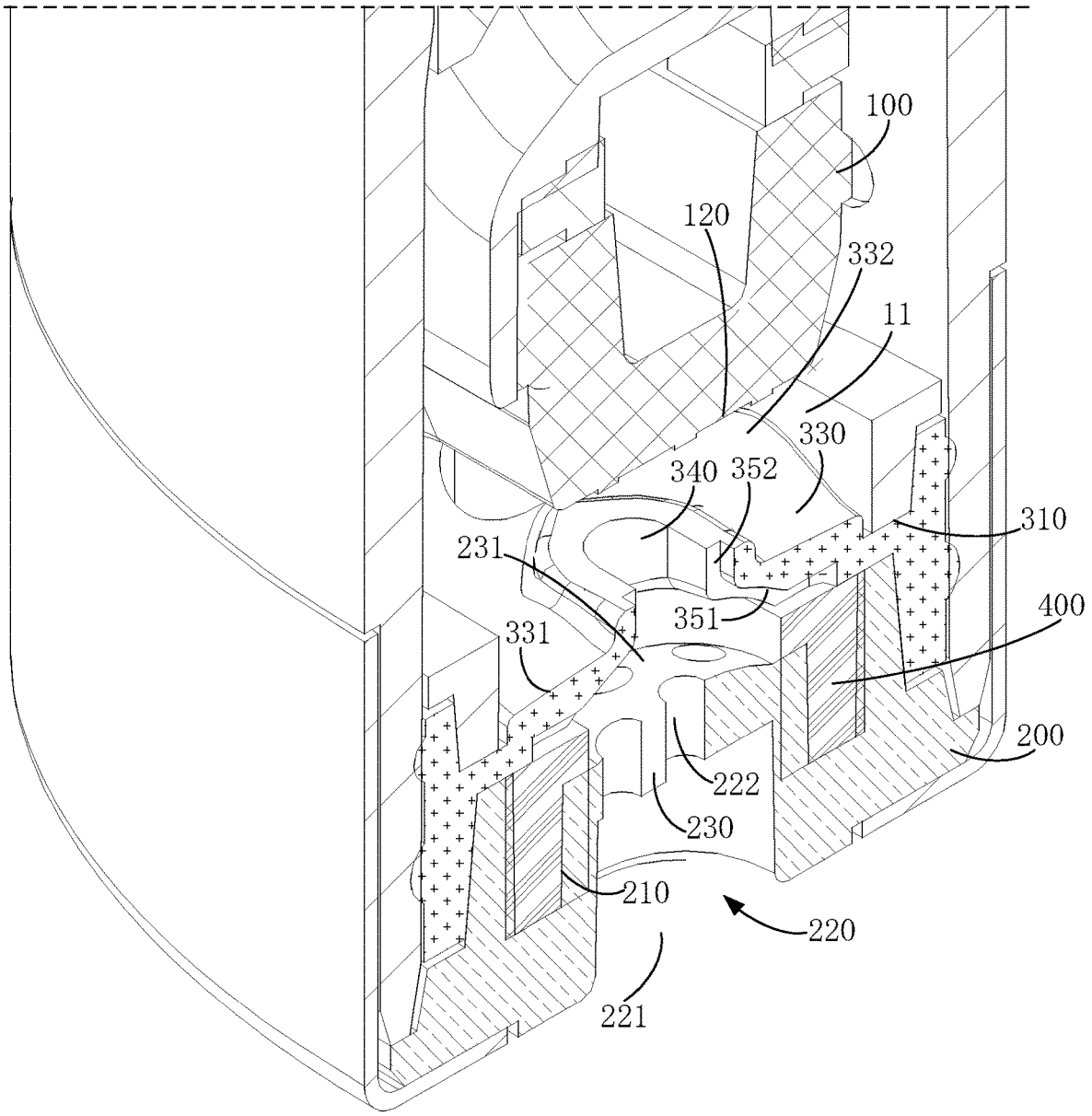
FIG. 3 is a partial perspective view of FIG. 2.

Referring to FIGS. 1, 2, and 3, the atomizer 10 according to an embodiment of the present disclosure is provided with an atomizing cavity 11, a liquid storage cavity 12, and an inhaling passage 13. The inhaling passage 13 is connected with the outside and the atomizing cavity 11. The inhaling passage 13 forms a nozzle 13*a* at an end. A user can inhale an aerosol from the nozzle 13*a*. The liquid storage cavity 12 is used to store an aerosol generating substrate. The aerosol generating substrate may be a liquid such as e-liquid. The atomizer 10 includes an atomizing core 100, a base 200, and a sealing member 300.

Figure 4:
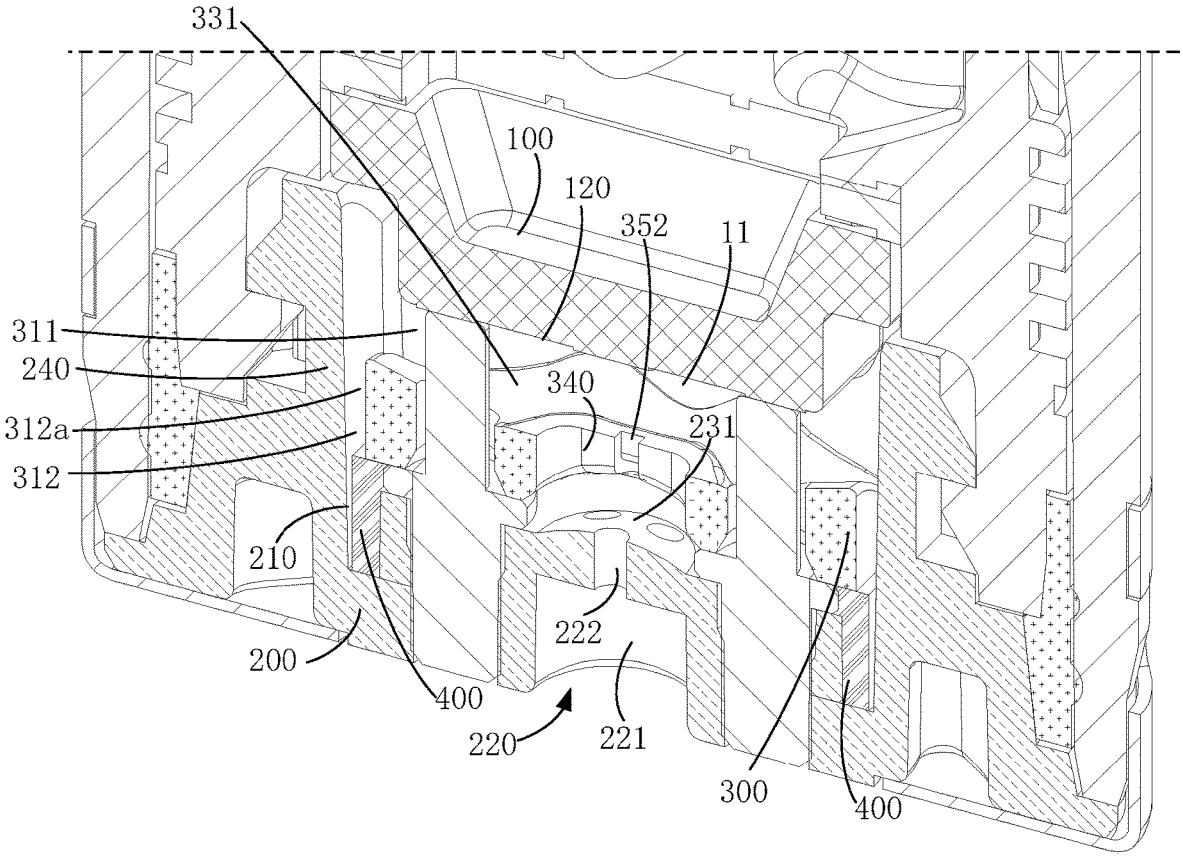
FIG. 4 is a perspective cross-sectional view of the atomizer of FIG. 1 in a second direction.
Figure 5:
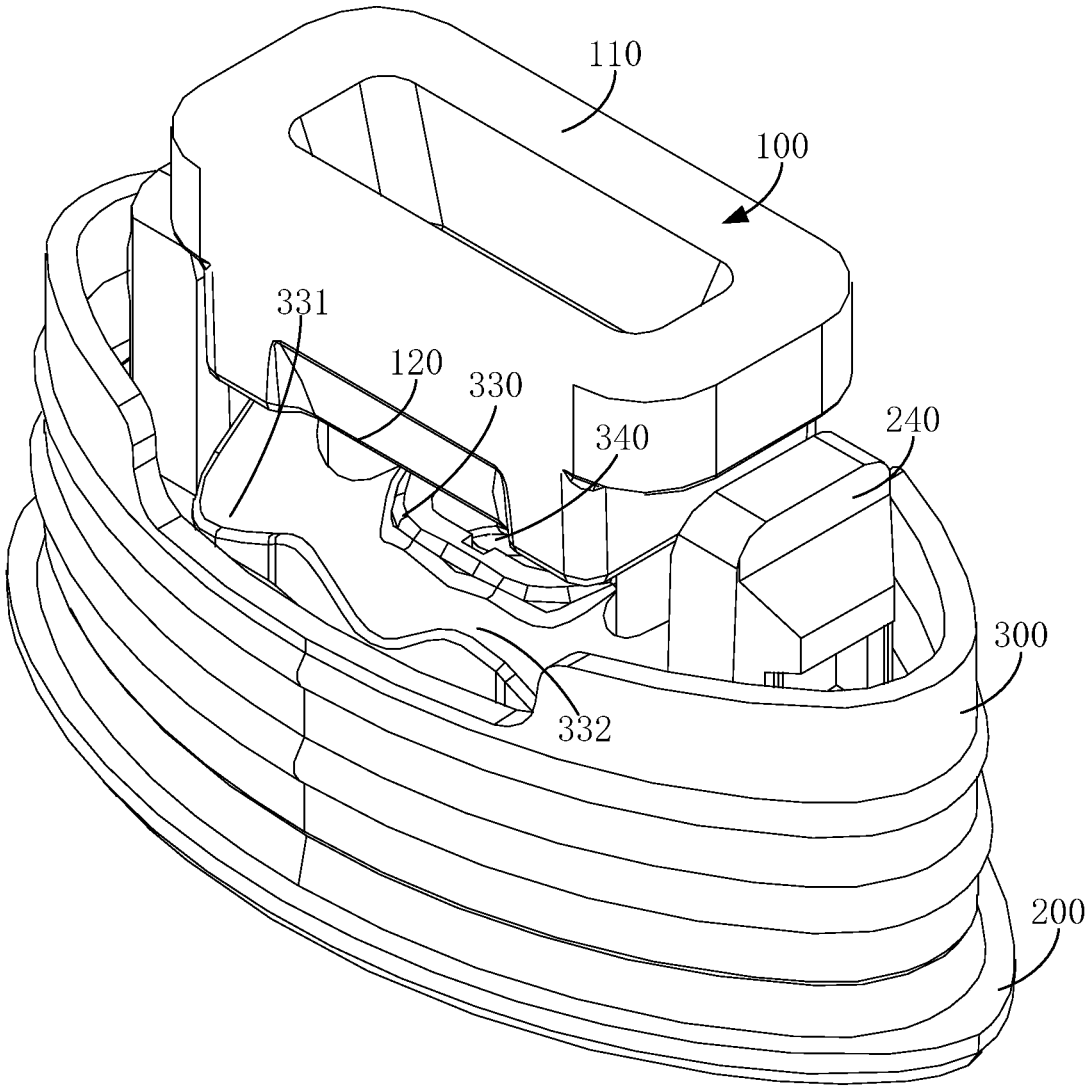
FIG. 5 is a partial perspective view of the atomizer of FIG. 1.

Referring to FIGS. 3, 4, and 5, in some embodiments, the atomizing core 100 may include a porous ceramic matrix 110 and a heating element. The porous ceramic matrix 110 has a large number of micropores therein and has an atomizing surface 120. The atomizing surface 120 may define a part of a boundary of the atomizing cavity 11. The heating element may be attached to the atomizing surface 120. The porous ceramic matrix 110 absorbs liquid from the liquid storage cavity 12 due to the capillary action of the micropores. When the heating element is energized to convert electrical energy into heat energy, the heating element can atomize the liquid on the atomizing surface 120 to form an aerosol and discharge the aerosol into the atomizing cavity 11. When the user inhales at the nozzle 13*a*, the aerosol in the atomizing cavity 11 will enter the inhaling passage 13 and reach the nozzle 13*a* to be inhaled by the user. Of course, in other embodiments, the atomizing core 100 may include a liquid absorbent cotton and a heating wire. The heating wire is wound on the liquid absorbent cotton. The liquid absorbent cotton absorbs liquid from the liquid storage cavity 12, and the heating wire generates heat when being energized, to atomize the liquid on the liquid absorbent cotton to form the aerosol that is discharged into the atomizing cavity 11.

Figure 6:
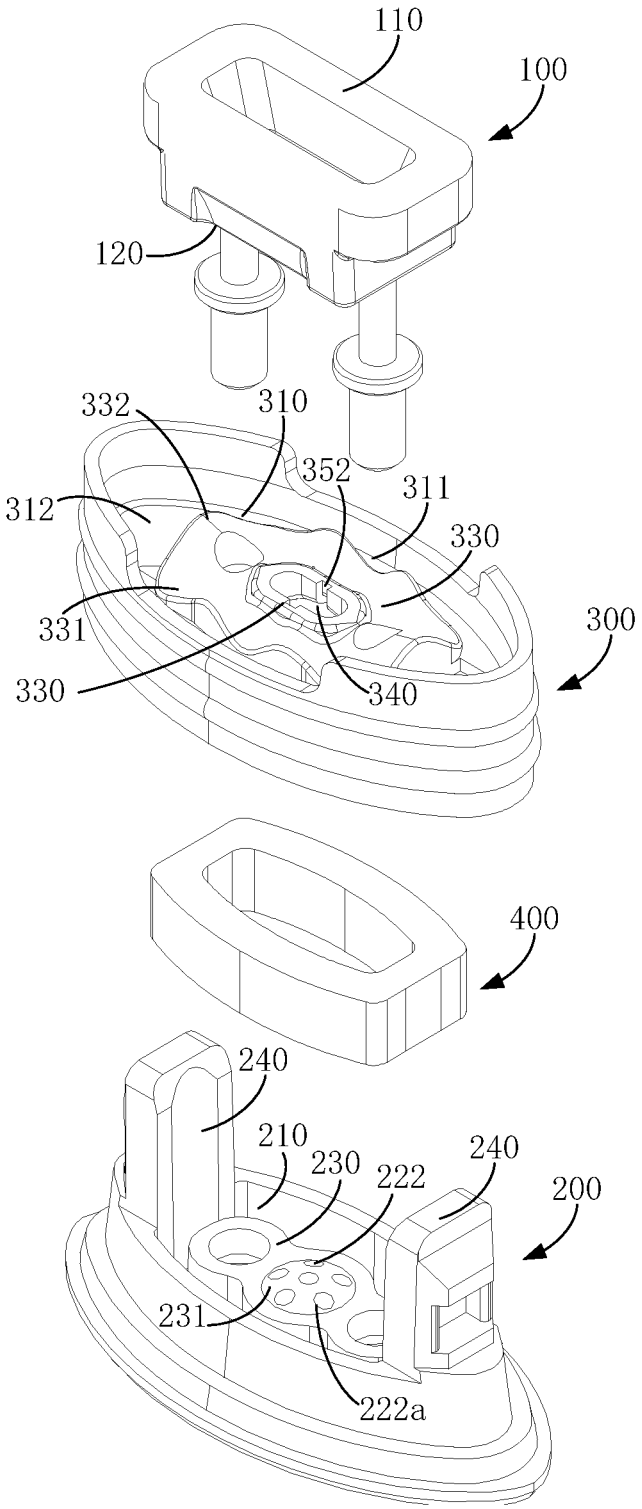
FIG. 6 is an exploded view of FIG. 5.
Figure 7:
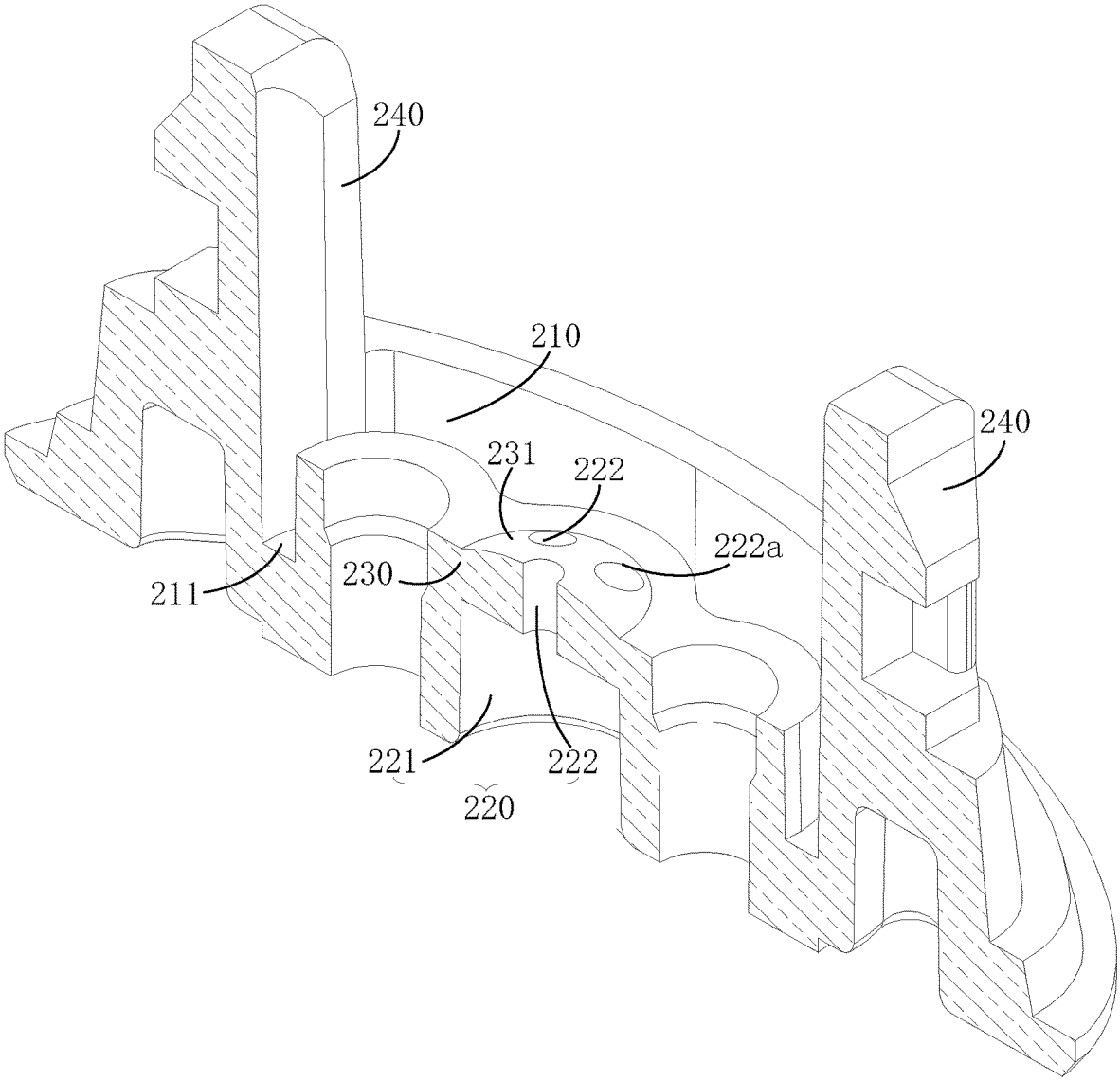
FIG. 7 is a perspective cross-sectional view of a base of the atomizer of FIG. 1.

Referring to FIGS. 5, 6, and 7, in some embodiments, the base 200 is provided with a storage portion 210 and an air inlet 220. The base 200 has a bottom wall surface 211 that defines a part of a boundary of the storage portion 210. The bottom wall surface 211 is disposed facing the atomizing core 100. That is, the bottom wall surface 211 is disposed upward. The base 200 includes a protruding portion 230 and two positioning posts 240. The two positioning posts 240 are disposed opposite to each other and both are located outside the storage portion 210. At least a part of the protruding portion 230 is located in the storage portion 210. For example, the protruding portion 230 may be entirely located in the storage portion 210. That is, the protruding portion 230 does not have a portion protruding outside the storage portion 210. A lower end of the protruding portion 230 is a fixed end and is connected to the bottom wall surface 211. An upper end of the protruding portion 230 is a free end. The protruding portion 230 protrudes toward the atomizing core 100 by a certain height relative to the bottom wall surface 211. The protruding portion 230 has a free end surface 231. The free end surface 231 is disposed toward the atomizing core 100. The free end surface 231 is spaced apart from the bottom wall surface 211 by a certain distance in an up and down direction. In other words, the free end surface 231 is located above the bottom wall surface 211, so that the free end surface 231 is located at a height higher than that of the bottom wall surface 211. A part of the air inlet 220 is located in the protruding portion 230. An upper end of the air inlet 220 passes through the free end surface 231.

The air inlet 220 includes an air intake hole 221 and a vent hole 222 that are connected with each other. One air intake hole 221 may be provided, and a plurality of vent holes 222 may be provided. An aperture of the air intake hole 221 may be much larger than that of the vent hole 222. A part of the air intake hole 221 is disposed in the protruding portion 230 and is connected with the outside. The vent hole 222 may be entirely disposed on the protruding portion 230 and located above the air intake hole 221. A lower end of the vent hole 222 is connected with the air intake hole 221. An upper end of the vent hole 222 passes through the free end surface 231, so that an opening is formed on the free end surface 231. The opening is termed as an output port 222*a* of the entire air inlet 220. Obviously, when the user inhales at the nozzle 13*a*, the outside air will enter the air inlet 220. The outside air in the air inlet 220 will finally be output from the output port 222*a* to the outside of the air inlet 220.

An aperture of the output port 222*a* can be about 0.1 mm. When liquid dropped on the free end surface 231 flows into the output port 222*a*, in view of the small aperture of the output port 222*a*, the liquid located in the output port 222*a* will generate surface tension. Under the obstruction of the surface tension, the liquid can be prevented from entering the inside of the vent hole 222 via the output port 222*a*, and the liquid can be prevented from leaking out of the entire atomizer 10 via the air intake hole 221, thereby improving the anti-leakage capability for liquid of the atomizer 10 to a certain extent. Of course, since the fluidity of the gas is higher than that of the liquid, the output port 222*a* and the entire vent hole 222 will not have any obstruction to the flow of gas, thereby ensuring that the gas in the entire air inlet 220 can be smoothly output via the output port 222*a*. In addition, although the aperture of the output port 222*a* is smaller, the number of the output ports 222*a* is larger, which can reduce the flow resistance of the outside air in the air inlet 220 when the user inhales, thereby reducing the inhaling force applied by the user and the inhaling resistance of the atomizer 10.

The free end surface 231 may have a mushroom-shaped curved surface structure. That is, from a center of the free end surface 231 to an edge thereof, a distance between the free end surface 231 and the bottom wall surface 211 gradually decreases from the center to the outside. In short, the free end surface 231 is higher at the center and lower at the edge, so that the free end surface 231 is inclined downward as a whole. Therefore, when the liquid drops on the free end surface 231, the liquid droplets can be prevented from staying on the free end surface 231 for a long time, ensuring that the liquid quickly falls from the free end surface 231 onto the bottom wall surface 211 subjected to its own gravity. As such, the liquid is stored in the space provided around the protruding portion 230 in the storage portion 210.

Since the output port 222*a* is located on the free end surface 231, and the free end surface 231 is higher than the bottom wall surface 211 by a certain distance, the storage portion 210 can store a certain amount of liquid, ensuring that the height of the liquid level in the storage portion 210 is difficult to reach the height of the free end surface 231. This prevents the liquid in the storage portion 210 from submerging the free end surface 231, and prevents the liquid in the storage portion 210 from leaking out of the atomizer 10 via the air inlet 220. Of course, since the output port 222*a* will generate surface tension that obstructs the flow of liquid, even if the liquid in the storage portion 210 just overflows or even submerges the output port 222*a*, it is difficult for the liquid in the storage portion 210 to quickly pass through the air inlet 220 in a short time to leak outside the atomizer 10.

Figure 8:
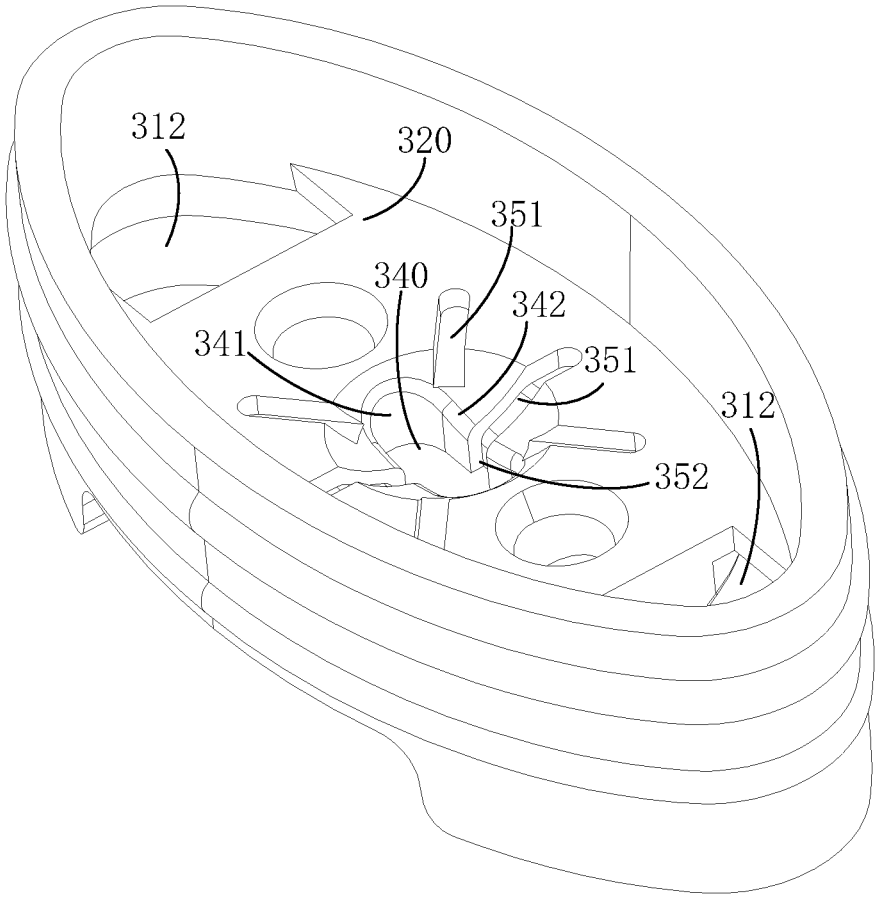
FIG. 8 is a perspective view of a sealing member of the atomizer of FIG. 1.
Figure 9:
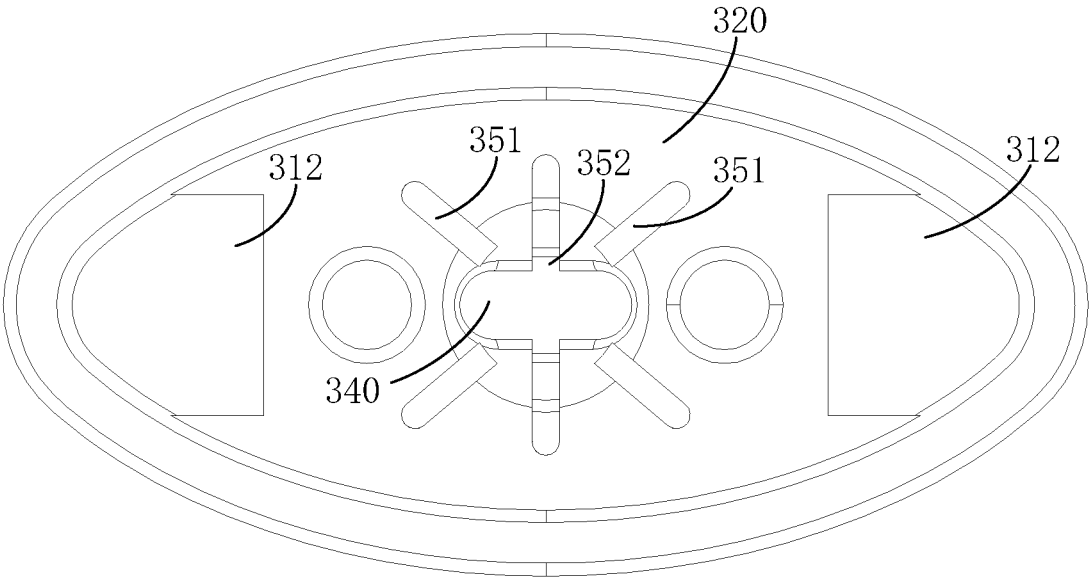
FIG. 9 is a top view of FIG. 8.
Figure 10:
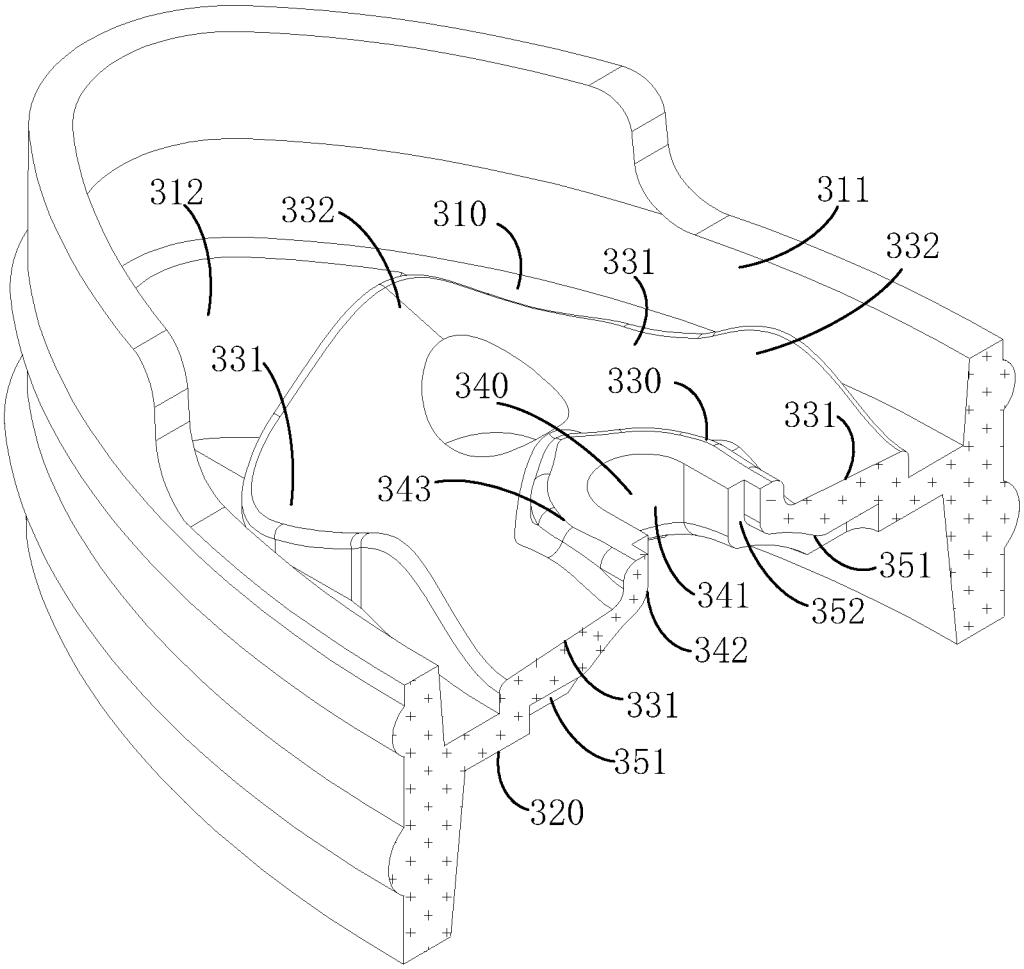
FIG. 10 is a perspective cross-sectional view of the sealing member of the atomizer of FIG. 1.

Referring to FIGS. 8, 9, and 10, in some embodiments, the sealing member 300 may be made of silicone materials and located below the atomizing core 100. The sealing member 300 has an upper surface 310 and a lower surface 320 that are opposite to each other. For example, the upper surface 310 faces upward and is disposed to face the atomizing core 100, and the lower surface 320 faces downward and is disposed to face away from the atomizing core 100. The sealing member 300 is provided with an open cavity 311 and a through hole 312. The upper surface 310 defines a part of a boundary of the open cavity 311. The upper surface 310 also defines a part of the boundary of the atomizing cavity 11. In fact, when the atomizer 10 is assembled, the atomizing cavity 11 may include at least a part of the open cavity 311. At least a part of a raised platform 330 is located in the open cavity 311. For example, the raised platform 330 may be entirely located in the open cavity 311. The raised platform 330 protrudes toward the atomizing core 100 by a certain height relative to the upper surface 310, and the through hole 312 passes through both the upper surface 310 and the lower surface 320, so that the through hole 312 and the open cavity 311 are connected with each other. When the sealing member 300 is mounted on the base 200, a part of the sealing member 300 is sleeved outside the base 200, and the positioning post 240 is disposed through the through hole 312. The positioning post 240 can function as positioning when mounting the sealing element 300, and the sealing member 300 covers the storage portion 210 of the base 200. Referring to FIG. 4, the positioning post 240 and the through hole 312 may be in a clearance fit. For example, there is a large clearance between the positioning post 240 and the through hole 312, so that the storage portion 210 is connected with the open cavity 311 via the remaining clearance 312*a* in the through hole 312. In this case, if there is liquid in the open cavity 311, the liquid can flow into the storage portion 210 through the remaining clearance 312*a* of the through hole 312. In other embodiments, the positioning post 240 and the through hole 312 may be in an interference fit. That is, the positioning post 240 completely blocks the through hole 312, so that the storage portion 210 cannot be connected with the open cavity 311 via the through hole 312. As such, even if there is liquid in the open cavity 311, the liquid cannot flow into the storage portion 210 via the through hole 312.

Figure 11:
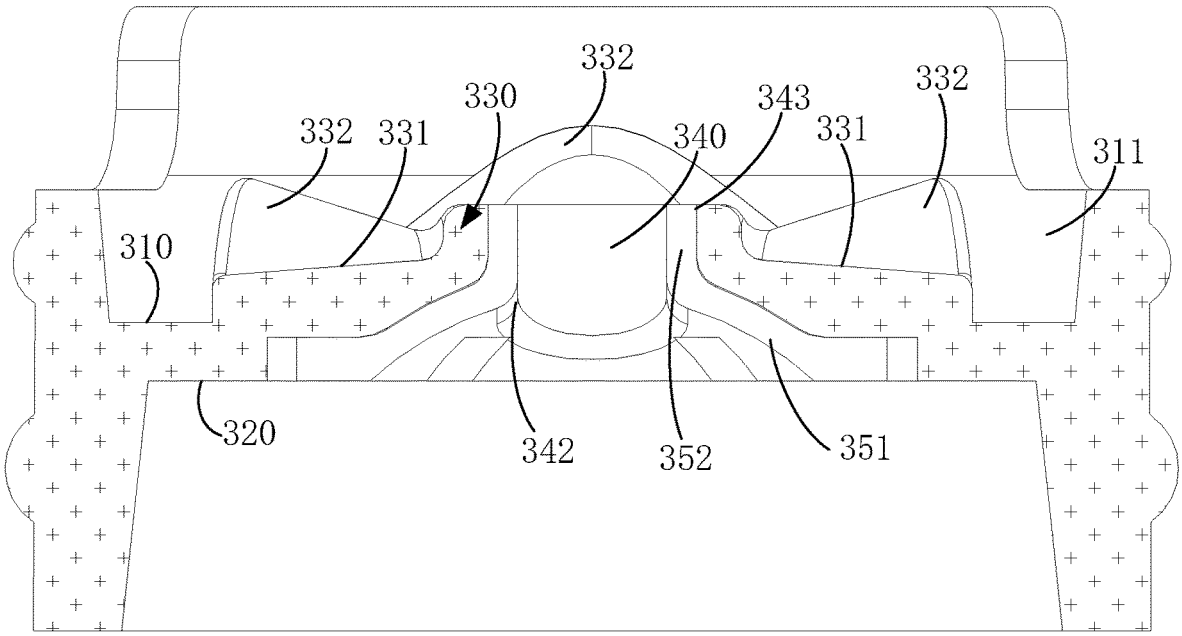
FIG. 11 is a planar cross-sectional view of the sealing member of the atomizer of FIG. 1.

Referring to FIGS. 10 and 11, the raised platform 330 is provided with an orifice 340. The orifice 340 channels air flow around the atomizing cavity 11 and the air inlet 220. The orifice 340 has an opening 343 on the raised platform 330. The opening 343 can allow the gas to flow out from the orifice 340 to enter the atomizing cavity 11. Obviously, the opening 343 located at a height higher than that of the upper surface 310. The raised platform 330 has an inclined surface 331. The inclined surface 331 is located outside the orifice 340 and faces upward to disposed facing the atomizing core 100, configured for transferring the liquid. The raised platform 330 further includes at least one raised portion 332. A plurality of raised portions 332 are provided. The plurality of raised portions 332 are disposed at intervals along the circumference of the orifice 340. The inclined surface 331 is connected between two adjacent raised portions 332, and the raised portions 332 protrude toward the atomizing core 100 by a certain height relative to the inclined surface 331, so that the raised portions 332 and the inclined surface 331 form a fold structure. Generally speaking, the raised platform 330 can be abstracted as a mountain, the raised portion 332 represents a peak, and the inclined surface 331 represents a valley. In a direction away from the orifice 340, a distance between the inclined surface 331 and the upper surface 310 gradually decreases, that is, the relative height of the inclined surface 331 gradually decreases. In other words, the inclined surface 331 is a slope inclined downwardly.

A lower end of the orifice 340 passes through the lower surface 320 of the sealing member 300 to form an input port 342. The outside air output from the output port 222*a* of the air inlet 220 will enter the orifice 340 from the input port 342. Therefore, referring to FIG. 2, when the user inhales at the nozzle 13*a*, the outside air sequentially passes through the air intake hole 221, the vent hole 222, and the orifice 340 to enter the atomizing cavity 11 to carry the aerosol. The aerosol carried by the outside air from the atomizing cavity 11 passes through the inhaling passage 13 to reach the nozzle 13*a* to be inhaled by the user. The dashed arrow in FIG. 2 indicates the flow trajectory of the air. An orthographic projection of the input port 342 on the base 200 may be located outside the output port 222*a*. That is, the input port 342 and the output port 222*a* are misaligned. In this case, the liquid dropped from the input port 342 cannot enter the output port 222*a*. Of course, the orthographic projection of the input port 342 on the base 200 can also cover the output port 222*a*. That is, the input port 342 is located directly above the output port 222*a*.

The lower surface 320 of the sealing member 300 is recessed upward by a predetermined depth to form a flow diverting groove 351. The flow diverting groove 351 is connected with the orifice 340. In view of the storage portion 210 having the space around the protruding portion 230, an end of the flow diverting groove 351 away from the orifice 340 is located directly above the space. More than one flow diverting groove 351 may be provided. The more than one flow diverting groove 351 is distributed radially around a central axis of the orifice 340. In other words, the flow diverting grooves 351 are located on different radii of the same circumference. The raised platform 330 further has a side wall surface 341. The side wall surface 341 defines the boundary of the orifice 340. The side wall surface 341 is provided with a drainage groove 352. The drainage groove 352 is connected with the flow diverting groove 351. An end of the drainage groove 352 away from the flow diverting groove 351 is located close to the inclined surface 331. The number of the drainage grooves 352 may be less than the number of the flow diverting grooves 351. In other words, some of the flow diverting grooves 351 are connected with the drainage grooves 352 at their ends.

Generally, the liquid seeps from the atomizing core 100 to form a seeped liquid, and the aerosol remaining in the atomizing cavity 11 form the condensate after being liquefied. The seeped liquid and the condensate can be termed as the leakage liquid. When the leakage liquid falls onto the inclined surface 331, since the inclined surface 331 inclines downward, the leakage liquid will fall along the inclined surface 331 to the upper surface 310 subjected to its own gravity. When the open cavity 311 is connected with the storage portion 210 via the through hole 312, the leakage liquid will also fall into the storage portion 210 via the through hole 312. When the open cavity 311 cannot be connected with the storage portion 210 via the through hole 312, the leakage liquid will be stored in the space where the open cavity 311 is disposed around the raised platform 330. When the leakage liquid falls on the side wall surface 341, due to the capillary tension formed by the flow diverting groove 351 on the leakage liquid, the leakage liquid in the orifice 340 enters the flow diverting groove 351, and flows into the storage portion 210 by guidance of the flow diverting groove 351. As such, the leakage liquid in the orifice 340 is prevented from directly falling from the output port 222*a* to the input port 342 that is directly below the output port 222*a*, and the leakage liquid is prevented from leaking out of the atomizer 10 via the air inlet 220.

In a case where the open cavity 311 cannot be connected with the storage portion 210 via the through hole 312, when the leakage liquid stored in the open cavity 311 overflows the raised platform 330, or when the atomizer 10 is inclined, the leakage liquid in the open cavity 311 will flow into the side wall surface 341 along the inclined surface 331. In this case, due to the effect of the drainage groove 352, the leakage liquid entering the orifice 340 will fall into the storage portion 210 via the drainage groove 352 and the flow diverting groove 351, which can also prevent the leakage liquid in the orifice 340 from directly falling into the input port 342 directly below the output port 222*a* via the output port 222*a*, to prevent the leakage liquid from leaking out of the atomizer 10 via the air inlet 220. Of course, in the case where the input port 342 is misaligned from the output port 222*a*, even if the leakage liquid flows out from the orifice 340, the leakage liquid cannot enter the output port 222*a*.

Due to the raised portion 332, the raised portion 332 can occupy a part of volume of the atomizing cavity 11, thereby reasonably compressing the volume of the atomizing cavity 11, that is, reducing the volume of the atomizing cavity 11. As a result, on the one hand, the total amount of aerosol remaining in the atomizing cavity 11 can be reduced, thereby reducing the amount of condensate formed by liquefying the aerosol. That is, the amount of leakage liquid is fundamentally reduced, thereby reducing the possibility of the leakage in the atomizer 10. On the other hand, the amount of gas in the atomizing cavity 11 can be reduced, thereby reducing the absorption of heat of the atomizing core 100 by the gas, and improving the energy utilization rate of the atomizing core 100, thereby increasing the atomizing efficiency and the amount of aerosol formed by atomization per unit time. In addition, the amount of aerosol remaining in the atomizing cavity 11 with a reduced volume will also be reduced, thereby reducing the waste of aerosol and increasing the amount of aerosol inhaled by the user per unit time. Moreover, the disposition of the raised portion 332 will further increase the structural strength and rigidity of the entire sealing member 300, avoid the deformation of the sealing member 300 during the assembly process, and improve the mounting accuracy of the sealing member 300 and ensure the sealing performance of the sealing member 300.

Of course, compared with the case of not providing the sealing member 300, the sealing member 300 according to the above embodiments can further prevent the base 200 from directly defining a part of the boundary of the atomizing cavity 11, prevent the leakage liquid from directly contacting the output port 222*a* of the air inlet 220, and avoid the leakage liquid from leaking out of the atomizer 10 via the air inlet 220.

Referring to FIGS. 4, 5, and 6, in some embodiments, the atomizer 10 further includes a liquid absorbing member 400. The liquid absorbing member 400 can be made of cotton materials, so that the liquid absorbing member 400 has a strong ability to absorb and accommodate the liquid. The liquid absorbing member 400 will be sleeved outside the protruding portion 230 and received in the storage portion 210. The liquid absorbing member 400 can abut against the lower surface 320 of the sealing member 300, so that the leakage liquid transferred out from the through hole 312 and the flow diverting groove 351 will be directly absorbed by the liquid absorbing member 400. Due to the liquid absorbing member 400, most of the leakage liquid in the storage portion 210 originally in a flowing state will be transformed into being a non-flowing state. Therefore, when the atomizer 10 is inclined or inverted, the leakage liquid in the non-flowing state in the liquid absorbing member 400 cannot enter the output port 222*a*, thereby further reducing the possibility of the leakage liquid leaking out of the atomizer 10 via the air inlet 220.

Figure 12:
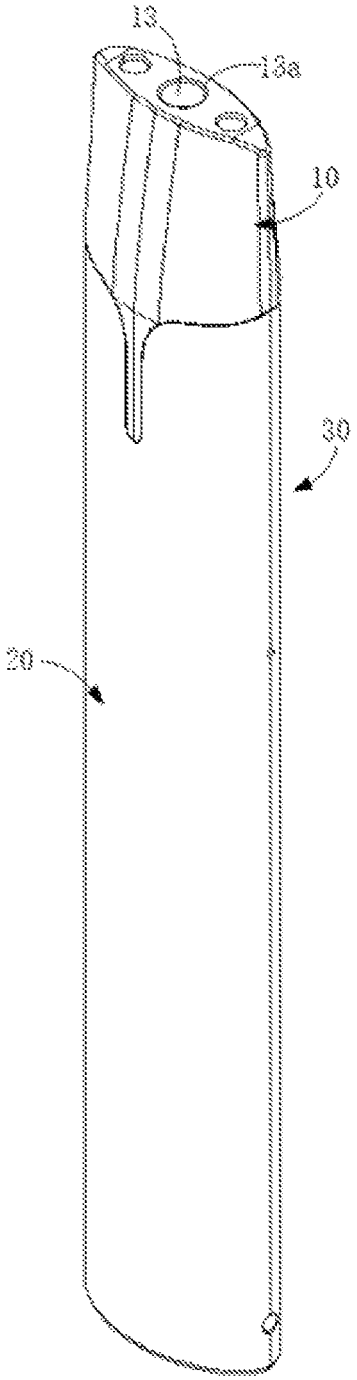
FIG. 12 is a perspective view of an electronic atomizing device according to an embodiment.

Referring to FIGS. 1, 2, and 12, the present disclosure also provides an electronic atomizing device 30. The electronic atomizing device 30 includes a power supply 20 and an atomizer 10. The power supply 20 is detachably connected to the atomizer 10. The power supply 20 can be recharged and recycled. The atomizer 10 can be a disposable consumable. When the liquid in the atomizer 10 is exhausted, the atomizer 10 is detached from the power supply 20, and a new atomizer 10 filled with liquid is remounted. Since the leakage liquid of the atomizer 10 cannot enter the power supply 20 via the air inlet 220, it is avoided that the leakage liquid corrodes the power supply 20 or even causes the explosion of the power supply 20, thereby improving the service life and safety of the power supply 20 and the electronic atomizing device 30.

The technical features of the above described embodiments can be combined arbitrarily. To simplify the description, not all possible combinations of the technical features in the above embodiments are described. However, all of the combinations of these technical features should be considered as being fallen within the scope of the present disclosure, as long as such combinations do not contradict with each other.

The foregoing embodiments merely illustrate some embodiments of the present disclosure, and descriptions thereof are relatively specific and detailed. However, it should not be understood as a limitation to the patent scope of the present disclosure. It should be noted that, a person of ordinary skill in the art may further make some variations and improvements without departing from the concept of the present disclosure, and the variations and improvements falls in the protection scope of the present disclosure. Therefore, the protection scope of the present disclosure shall be subject to the appended claims.

What is claimed is:

1. An atomizer provided with an atomizing cavity, the atomizer comprising:

an atomizing core configured to atomize an aerosol generating substrate to form an aerosol;

a base provided with an air inlet; and a sealing member disposed on the base, the sealing member having an upper surface facing the atomizing core, the sealing member comprising a raised platform connected to the upper surface and protruding opposite to the upper surface;

wherein the raised platform is provided with an orifice channeling air flow around the atomizing cavity and the air inlet, the raised platform has an inclined surface located outside the orifice and facing the atomizing core, for transferring liquid; in a direction away from the orifice, a distance between the inclined surface and the upper surface gradually decreases, wherein the base includes a protruding portion that protrudes toward the atomizing core relative to a bottom wall surface of the base, an upper end of the protruding portion being a free end surface that is curved;

wherein an upper end of the air inlet passes through the free end surface.

2. The atomizer according to claim 1, wherein the base is further provided with a storage portion configured to store the aerosol generating substrate, the sealing member further comprises a lower surface away from the atomizing core, the orifice passes through the lower surface, the lower surface is provided with a flow diverting groove connected with the orifice, the flow diverting groove transfers the aerosol generating substrate from the orifice into the storage portion.

3. The atomizer according to claim 2, wherein more than one flow diverting groove is provided, the more than one flow diverting groove is distributed radially around a central axis of the orifice.

4. An atomizer, provided with an atomizing cavity, and comprising:

an atomizing core configured to atomize an aerosol generating substrate to form an aerosol;

a base provided with an air inlet; and a sealing member disposed on the base, and having an upper surface facing the atomizing core, the sealing member comprising a raised platform connected to the upper surface and protruding opposite to the upper surface, wherein the raised platform is provided with an orifice channeling air flow around the atomizing cavity and the air inlet, the raised platform has an inclined surface located outside the orifice and facing the atomizing core, for transferring liquid; in a direction away from the orifice, a distance between the inclined surface and the upper surface gradually decreases;

wherein the base is further provided with a storage portion configured to store the aerosol generating substrate, the sealing member further comprises a lower surface away from the atomizing core, the orifice passes through the lower surface, the lower surface is provided with a flow diverting groove connected with the orifice, the flow diverting groove transfers the aerosol generating substrate from the orifice into the storage portion; and wherein the raised platform has a side wall surface defining a boundary of the orifice, the side wall surface is provided with a drainage groove connected with the flow diverting groove, an end of the drainage groove away from the flow diverting groove is located close to the inclined surface.

5. The atomizer according to claim 2, wherein the sealing member is provided with an open cavity, at least a part of the raised platform is located in the open cavity, the upper surface defines a part of a boundary of the open cavity, the upper surface is provided with a through hole, the base comprises a positioning post cooperating with the through hole, the through hole is located in a remaining clearance between the positioning post and the sealing member, the remaining clearance connects the storage portion and the open cavity.

6. The atomizer according to claim 2, wherein the base has a bottom wall surface facing the atomizing core and defining a part of a boundary of the storage portion, the base comprises a protruding portion, at least a part of the protruding portion is located in the storage portion, the protruding portion is connected to the bottom wall surface and protrudes relative to the bottom wall surface, the protruding portion has a free end surface spaced apart from the bottom wall surface, the air inlet passes through the free end surface.

7. The atomizer according to claim 2, wherein the sealing member is sleeved on the base and covers the storage portion.

8. The atomizer according to claim 2, further comprising a liquid absorbing member, the liquid absorbing member is located in the storage portion and abuts against the sealing member, and is capable of absorbing the aerosol generating substrate from the orifice.

9. An atomizer, provided with an atomizing cavity, and comprising:

an atomizing core configured to atomize an aerosol generating substrate to form an aerosol;

a base provided with an air inlet; and a sealing member disposed on the base, and having an upper surface facing the atomizing core, the sealing member comprising a raised platform connected to the upper surface and protruding opposite to the upper surface, wherein the raised platform is provided with an orifice channeling air flow around the atomizing cavity and the air inlet, the raised platform has an inclined surface located outside the orifice and facing the atomizing core, for transferring liquid;

in a direction away from the orifice, a distance between the inclined surface and the upper surface gradually decreases;

wherein the raised platform further comprises at least two raised portions disposed at intervals along a circumference of the orifice, the raised portion protrudes toward the atomizing core relative to the inclined surface, and the inclined surface is located between two adjacent raised portions.

10. An electronic atomizing device, comprising a power supply and the atomizer according to claim 1, wherein the atomizer is detachably connected to the power supply.

* * * * *